US006123330A

United States Patent [19]

Schaal

[11] Patent Number: 6,123,330

[45] Date of Patent: Sep. 26, 2000

[54] METHOD OF FEEDING FLAT MAIL FOR SEPARATION BY SUCTION OF MATERIAL INPUT

[75] Inventor: Falk Schaal, Alpirsbach, Germany

[73] Assignee: Siemens Aktiengesellschaft, Munich, Germany

[21] Appl. No.: 09/077,611

[22] PCT Filed: Nov. 27, 1996

[86] PCT No.: PCT/EP96/05233

§ 371 Date: Jun. 2, 1998

§ 102(e) Date: Jun. 2, 1998

[87] PCT Pub. No.: WO97/20762

PCT Pub. Date: Jun. 12, 1997

[30] Foreign Application Priority Data

Dec. 2, 1995 [DE] Germany ..... 195 45 057

[51] Int. Cl.[7] ..... B65H 7/02

[52] U.S. Cl. ..... 271/31; 271/94; 271/31.1; 271/265.04; 271/150; 271/153; 271/155; 271/10.06

[58] Field of Search ..... 271/10.03, 11, 271/94, 96, 31, 31.1, 263, 265.04, 150, 152, 153, 154, 155, 10.06

[56] References Cited

U.S. PATENT DOCUMENTS

| | | | |
|---|---|---|---|
| 5,029,837 | 7/1991 | Uchiyama | 271/263 |
| 5,577,720 | 11/1996 | Lasklowski | 271/263 |
| 5,645,274 | 7/1997 | Ubayashi et al. | 271/265.04 |

FOREIGN PATENT DOCUMENTS

| | | | |
|---|---|---|---|
| 2649086 | 1/1991 | European Pat. Off. . | |
| 000507661 A1 | 10/1992 | European Pat. Off. | 271/94 |
| 4021444 A1 | 1/1992 | Germany | B65H 3/04 |
| 4216146 C1 | 12/1993 | Germany | G01B 11/06 |
| 1-187137 | 7/1989 | Japan | 271/96 |
| 05132196 | 5/1993 | Japan . | |
| 06329275 | 11/1994 | Japan . | |
| 2037 261 | 7/1980 | United Kingdom | 271/153 |
| 87/02018 | 4/1987 | WIPO . | |
| 93/14475 | 7/1993 | WIPO . | |

*Primary Examiner*—H. Grant Skaggs
*Attorney, Agent, or Firm*—Venable; George H. Spencer; Robert Kinberg

[57] ABSTRACT

The invention relates to a method for the steady feeding of flat items for separation by suction of material input into a distribution unit by using a feeding device, preferably comprising a separating blade and a conveyor belt underneath it. In accordance with the invention, the thickness of the pulled-off items is measured within a main control circuit (HR). The feeding device conveys the item stack (SS) by the amount of this thickness in the direction of the suction separation system. In a static correction control circuit (KR), the stack pressure is measured outside of the suction separation system and is adjusted via the movement of the feeding device within the limits of the permissible stack pressure range.

6 Claims, 2 Drawing Sheets

METHOD OF FEEDING FLAT MAIL FOR SEPARATION BY SUCTION OF MATERIAL INPUT

BACKGROUND OF THE INVENTION

The invention relates to a method for feeding flat items for separation by suction of material input into a distributing unit by using a feeding device, preferably comprising a separating blade and a conveyor belt arranged underneath.

The items are fed to the system for separation by suction by way of the separating blade and the conveyor belt arranged underneath. If the pressure in the item stack is high, there is danger that two articles are pulled off at the same time as a result of the frictional force between the individual items. On the other hand, if the item stack is not compact enough, the throughput is relatively low. The individual items additionally can tip over, thereby worsening the pull-off behavior. For that reason, a certain stack pressure range must be maintained in the separating region.

A suction device is installed underneath perforated friction belts to achieve an increase in the frictional force between the first item and the friction belt for the separation system. Consequently, the stack pressure is up to now checked with sensing levers and position sensors, which switch the separating blade and the conveyor belt underneath and thus also the item feeding device on and off via a two-position control. The sensing levers here are located in the region where the items are suctioned out. The sensing levers are consequently actuated by an excessively high stack pressure as well as by items that are suctioned in. The operation for controlling the stack pressure thus is not defined clearly. Thus, suctioned-in postcards can stop the separating blade and the conveyor belt underneath via the sensing levers as soon as a gap forms in the stack of items in front of the pull-off location. After all the items in front of this gap have been separated, the feeding device must move the item stack at least by the amount of the gap in the direction of the pull-off point until further items can be separated. As a result, larger gaps form in the conveying section, following the separation, and these worsen the throughput. In those cases, there is also an increased tendency to pull off two items at the same time, owing to the briefly increased stack pressure.

A further disadvantage arises from the fact that the sensing levers are spring-weight-systems, which vibrate strongly during the separation by suction.

SUMMARY OF THE INVENTION

It is the object of the invention, to create a method for feeding flat items to the system for separation by suction of material input, which method eliminates the shortcomings in the state of the technology, so that a steady feeding and separation of the item stacks is achieved.

The advantage of the solution according to the invention is that it removes the undefined condition during the control of the suction separation feeding, during which a feeding stop could be triggered by an excessively high stack pressure as well as a single item suctioned in.

In one advantageous embodiment, the thickness of the pulled-off item is determined via the deflection of a swivelling roller, by means of a rotary potentiometer. In a further advantageous embodiment of the invention, the stack pressure is measured at the feeding device via a spring-mounted and damped separating blade and position sensors, arranged on both sides of the separating blade.

The invention is explained further with an example and with the aid of the drawings, which show in:

DETAILED DESCRIPTION OF THE DRAWINGS

Figure 2:
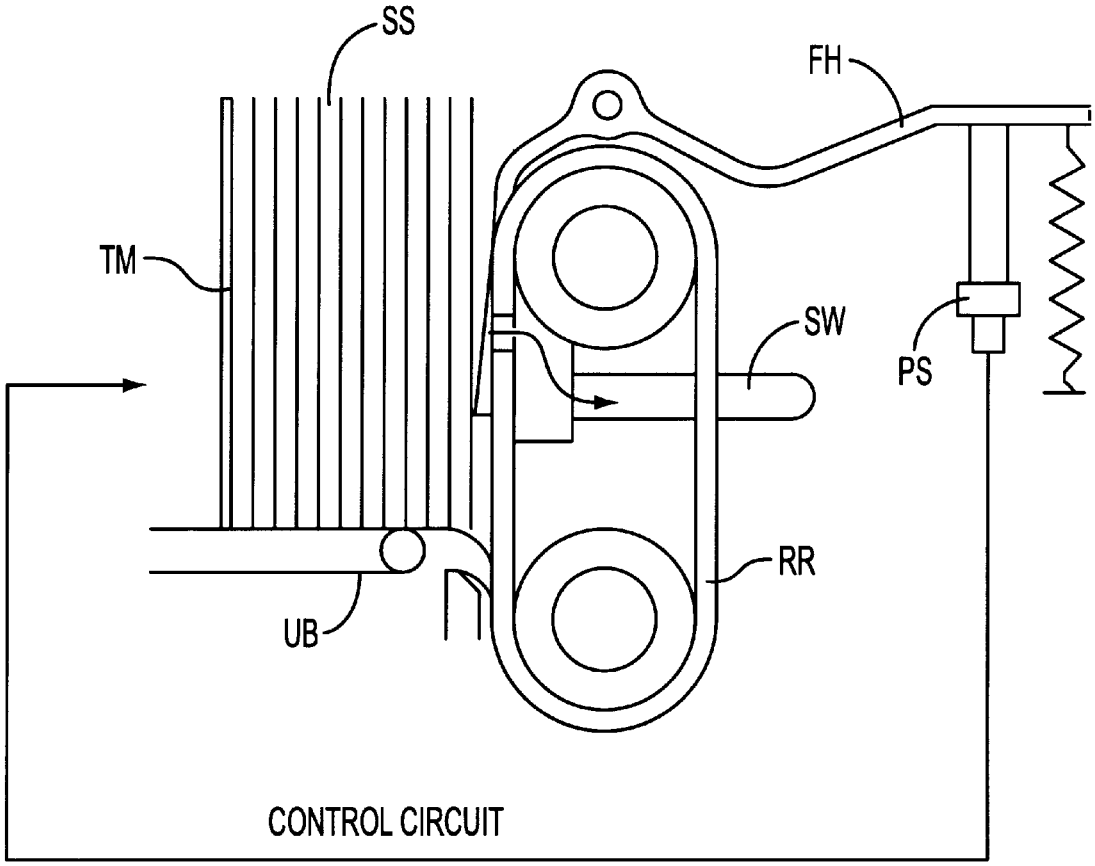
FIG. 2 PRIOR ART
FIG. 2 A basic diagram of a device for executing the method used heretofore.

FIG. 2 shows that the item stack SS is fed to the system for separation by suction with the aid of the separating blade TM and the conveyor belt UB underneath it. In order to increase the frictional force between the first item and friction belts RR for pulling off the items, these belts have a perforated design with a suction device SW located underneath the friction belts RR. Owing to the vacuum in the suction device SW, the front item is pulled toward the friction belts RR.

To achieve an even stack pressure in the item stack, the stack is controlled via the sensing levers FH and the position sensors PS, which turn the separating blade TM and the conveyor belt UB underneath it on and off via a two-position control. A feeding stop can also be triggered by a suctioned-out item, even though there is a gap in the item stack SS after this item.

Figure 1:
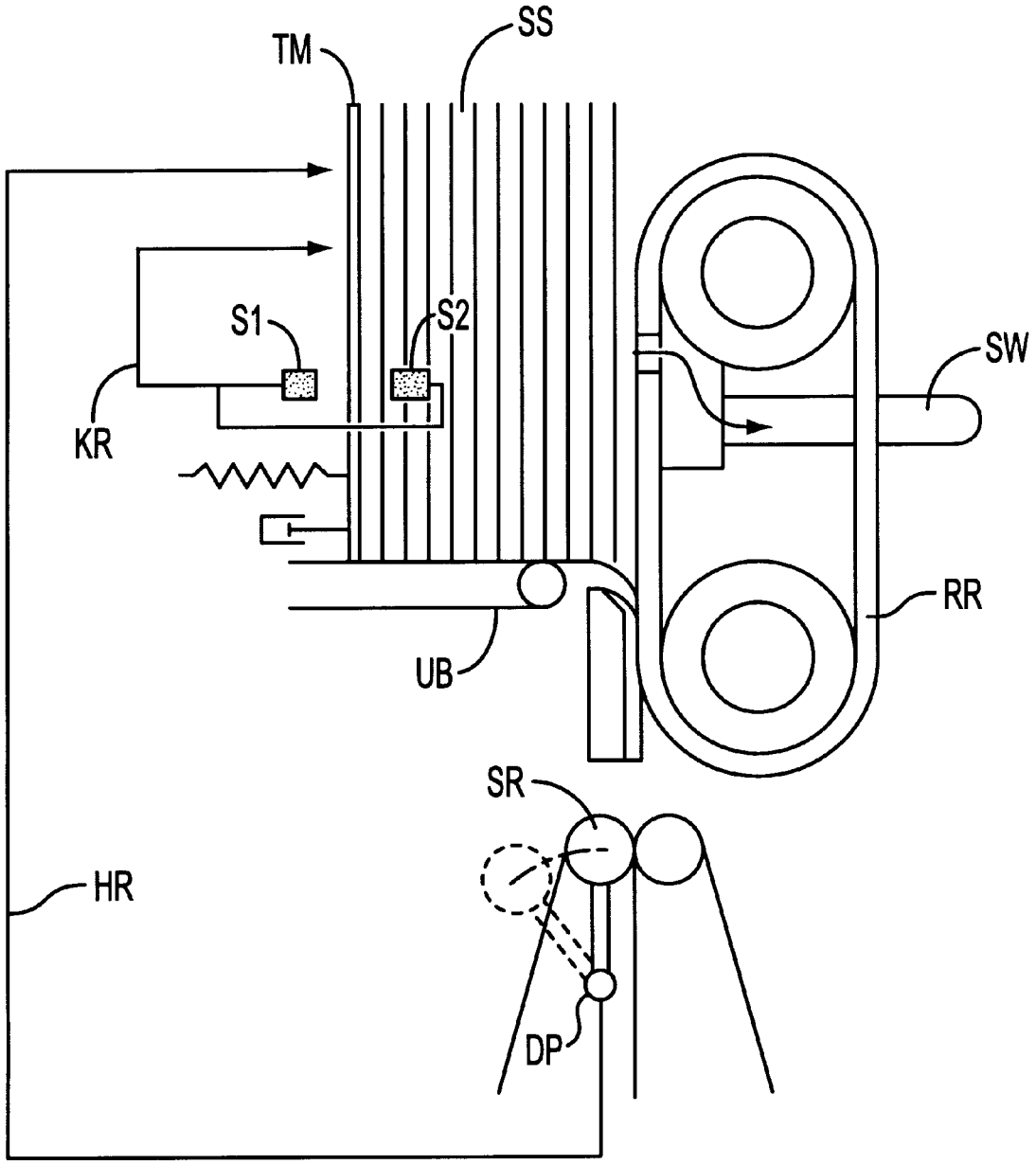
FIG. 1 A basic diagram of a device for executing the method according to the invention.

The solution according to the invention, based on FIG. 1, provides that the thickness of each pulled-off item is measured with a rotary potentiometer DP at a swivelling roller SR in the transfer region. The rigidity of the spring for swiveling roller SR is selected high enough, so that stronger vibrations can be ruled out and the dynamic influence therefore is insignificant. The separating blade TM or the conveyor belt UB underneath it track the respectively measured thickness in a main control circuit HR.

However, possible errors in the thickness measuring can add up when using this control principle. Also, the system does not detect whether the item stack SS has the right stack pressure from the start. The stack pressure is therefore monitored and corrected in a correction control circuit KR.

This control circuit can remain on static control, owing to the few readjustments that are required.

In the cited example, the stack pressure is controlled with the aid of two position sensors S1 and S2, which are positioned to the left and right of a spring-mounted separating blade TM. If the stack pressure is too high, the separating blade TM approaches the position sensor S1 which then switches. If the stack pressure is too low, the position sensor S2 switches. The separating blade TM is damped, so that the two position sensors S1 and S2 do not react to short-term pressure fluctuations in the item stack SS. The items fit better against the friction belt RR because the presently used sensing levers FH are omitted. This improves the pull-off behavior considerably.

What is claimed is:

1. A method for feeding flat items for separation by suction of material input into a distribution unit through a suction separation system, by using a feeding device comprising the steps of:

measuring a thickness of a pulled-off item in a main control circuit transporting an item stack by the amount of the measured thickness in the direction of the suction separation system;

measuring a stack pressure outside of the suction separation system in a static correction control circuit; and adjusting the stack pressure by means of moving the feeding device within the limits of a permissible stack pressure range.

2. A method according to claim 1, wherein the step of measuring a thickness further comprises:

deflecting a swiveling roller to measure the thickness of the pulled-off items.

3. A method according to claim 2, wherein the step of measuring the thickness further comprises:

measuring the deflection of the swiveling roller with a rotary potentiometer.

4. A method according to claim 1, wherein the step of measuring the stack pressure occurs at the feeding device.

5. A method for feeding flat items for separation by suction of material input into a distribution unit through a suction separation system, by using a feeding device, comprising the steps of:

measuring a thickness of a pulled-off item in a main control circuit;

transporting an item stack by the amount of the measured thickness in the direction of the suction separation system;

measuring a stack pressure outside of the suction separation system in a static correction control circuit the stack pressure being measured via a spring-mounted and damped separating blade and position sensors arranged on both sides of the separating blade; and adjusting the stack pressure by means of moving the feeding device within the limits of a permissible stack pressure range.

6. A method for feeding flat items for separation by suction of material input into a distribution unit through a suction separation system, by using a feeding device, comprising the steps of:

measuring a thickness of a pulled-off item in a main control circuit;

transporting an item stack by the amount of the measured thickness in the direction of the suction separation system;

measuring a stack pressure outside of the suction separation system, at the feeding device, in a static correction control circuit the stack pressure being measured via a spring-mounted and damped separating blade and position sensors arranged on both sides of the separating blade; and adjusting the stack pressure by means of moving the feeding device within the limits of a permissible stack pressure range.

* * * * *